US006106310A

United States Patent [19]

Davis et al.

[11] Patent Number: 6,106,310

[45] Date of Patent: Aug. 22, 2000

[54] PANEL-GROUNDING CONTACT

[75] Inventors: Wayne Samuel Davis, Harrisburg; Robert Neil Whiteman, Jr., Middletown, both of Pa.

[73] Assignee: The Whitaker Corporation, Wilmington, Del.

[21] Appl. No.: 09/176,610

[22] Filed: Oct. 21, 1998

Related U.S. Application Data

[60] Provisional application No. 60/065,497, Nov. 19, 1997.

[51] Int. Cl.[7] ..... H01R 4/66; H01R 3/06

[52] U.S. Cl. ..... 439/95; 339/14; 439/92

[58] Field of Search ..... 439/92, 855, 853, 439/858, 865, 881

[56] References Cited

U.S. PATENT DOCUMENTS

| | | | |
|---|---|---|---|
| 3,686,609 | 8/1972 | Hansen | 339/14 R |
| 3,910,663 | 10/1975 | Winger | 439/92 |
| 4,029,384 | 6/1977 | Reinwall, Jr. | 339/98 |
| 4,659,869 | 4/1987 | Busby | 174/35 GC |
| 4,669,808 | 6/1986 | Owen | 439/858 |
| 4,874,336 | 10/1989 | Marsh | 439/607 |
| 4,993,959 | 2/1991 | Randolph | 439/92 |

FOREIGN PATENT DOCUMENTS 907316 10/1962 United Kingdom .

936573 9/1963 United Kingdom .

OTHER PUBLICATIONS

*AMP Catalog No. 4507–1*, Engineering and Purchasing Guide Fifth Edition, p. A–185; 1984; AMP Incorporated, Harrisburg, PA.

AMP Product Information Bulletin 65045, Grounding Clip Terminal, 2 pages; Mar. 1992; AMP Incorporated, Harrisburg, PA.

AMP Drawing No. 61980, Rev. D, Grounding Clip; Sep. 1992; AMP Incorporated, Harrisburg, PA.

AMP Drawing No. 63575, Clip, Grounding; Mar. 1991; AMP Incorporated, Harrisburg, PA.

*Primary Examiner*—Paula Bradley
*Assistant Examiner*—Edwin A. León
*Attorney, Agent, or Firm*—Michael Aronoff

[57] ABSTRACT

A panel-grounding contact (10) includes a wire-connecting section (14) and a panel-connecting section (12) having a deep U-shaped channel (46) between walls (30,42,44) that include opposed pairs of teeth (50,58) extending toward the channel bottom (54) and staggered inwardly from the channel entrance (48), with the points of the teeth (50,58) adapted to scrape away corrosion layers of a conductive panel (70) during mounting of the grounding clip onto an edge thereof as well as to secure the contact (10) on the panel. The wire-connecting section (14) extends orthogonally with respect to the panel edge after mounting of the clip onto the panel.

11 Claims, 2 Drawing Sheets

FIG. 1
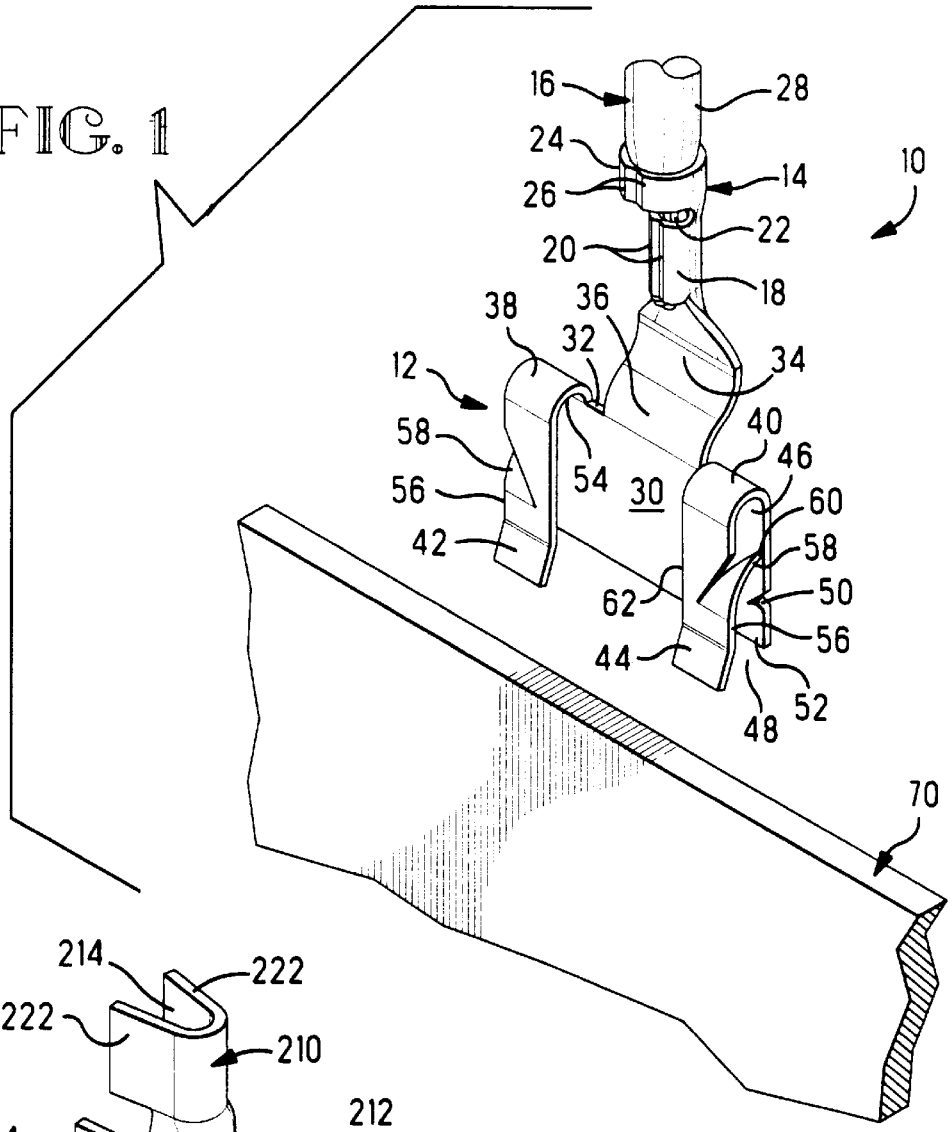
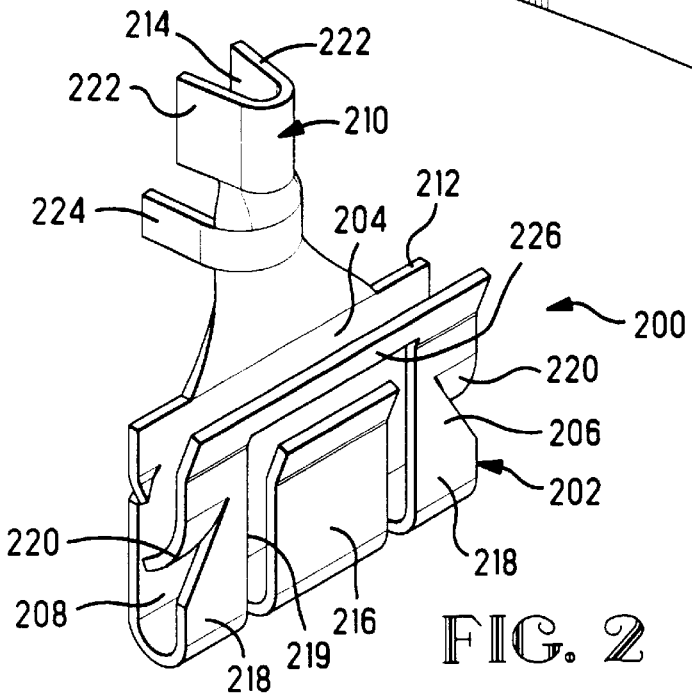
FIG. 2

PANEL-GROUNDING CONTACT

This application claims benefit of provisional application Ser. No. 60/065,497 filed Nov. 19, 1997.

FIELD OF THE INVENTION

This relates to the field of electrical connections and more particularly to electrical terminals.

BACKGROUND OF THE INVENTION

A certain grounding contact or clip is known that is terminatable to a conductor wire by crimping, and is then adapted to be grounded to a conductive panel at an edge thereof. One example of such a contact is sold by AMP Incorporated, Harrisburg, PA under Part No. 61980, that includes a wire connecting section adapted to be crimped onto a stripped wire end, and a plate-engaging section having a deep U-shaped channel that is adapted to be urged onto an edge of a conductive plate, such as the housing or frame of an appliance. The plate-engaging section includes opposed lances stamped from the side walls inwardly and having free ends facing away from the channel opening to bite into the panel to resist inadvertent removal.

In another grounding clip sold by AMP Incorporated as Part No. 63575-1, a crimpable wire-connecting section is defined on a portion of a first side wall of the plate-engaging U-shaped channel that is stamped out therefrom and bent to extend outwardly from and beneath the channel bottom midway along the channel; the wire extends parallel to, beneath and adjacent the channel after crimping. The remaining portions of the first side wall include elongate teeth stamped to extend toward the channel bottom and extend inwardly toward the opposed second side wall, while the second side wall includes smaller pointed teeth nearer the channel entrance. The plate-engaging section is more resilient than that of Part No. 61980 above and accommodates a relatively wide range of panel thicknesses, but wire termination to the clip is more difficult.

It is desired to provide an assured ground connection of a ground contact to a panel, that provides ease of wire termination and provides substantial resilience in the plate-engaging section.

SUMMARY OF THE INVENTION

The contact of the present invention includes a panel-connecting section having a deep U-shaped channel for receiving a panel in a panel mounting direction between walls that include opposed pairs of teeth extending toward the channel bottom and staggered inwardly from the channel entrance, the points of the teeth adapted to scrape away corrosion layers of a conductive panel during mounting onto an edge thereof as well as secure the contact on the panel. The wire-connecting section concludes an insulation-gripping section and extends from the panel-connecting section, in a direction parallel to the panel mounting direction with the clip being free of torque resulting from a wire that in the prior art extends laterally from the grounding clip with an accompanying tendency to pull the grounding clip from the panel.

Embodiments of the ground contact will now be described by way of example with reference to the accompanying drawings.

BRIEF DESCRIPTION OF THE DRAWINGS

FIG. 1 is an isometric view of the contact of the present invention crimped onto a wire and positioned to be urged onto an edge of a conductive plate;

FIG. 2 is an isometric view of a second embodiment of contact wherein the wire-connecting section extends from the top edge of a side wall of the panel-engaging section and is offset from the panel-receiving channel for the wire to extend along the panel;

DETAILED DESCRIPTION

Figure 4:
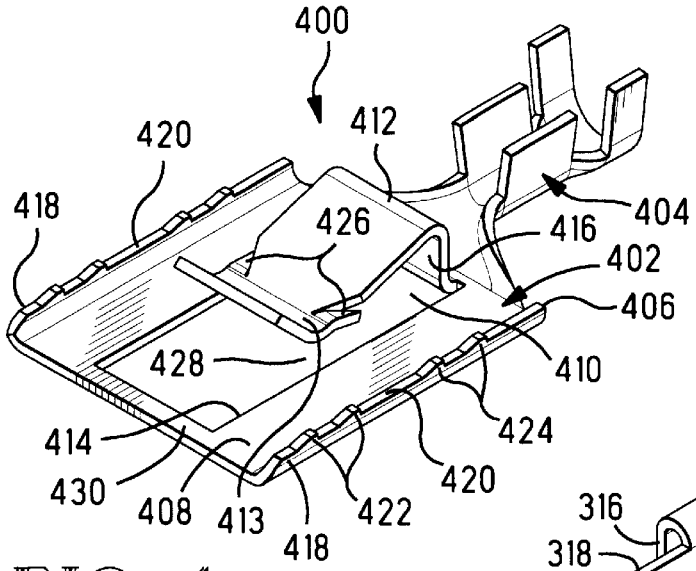
FIG. 4 is an isometric view of a fourth embodiment of the contact wherein the wire-connecting section extends from the lower edge of a first side wall and the opposed side wall is formed from a tab stamped from the first side wall.

In FIG. 1, contact 10 includes a plate-engaging section or body section 12 and a wire-connecting section 14 for termination to an insulated wire 16. Wire-crimping section 18 includes a pair of opposed arms 20 coextending upwardly that are crimped around the end of conductor 22 after stripping of insulation from the end of the wire, while insulation-gripping section 24 includes opposed elongated arms 26 that are crimped around the insulative jacket 28 of wire 16 spaced from the stripped end.

Plate-engaging section 12 includes a first side wall 30 having a lower edge 32 (with respect to the panel-receiving channel), with wire-connecting section 14 defined on a tab 34 extending from a central portion 36 of lower edge 32. Adjacent to central portion 36, a pair of bights 38,40 extend to respective opposed second side wall sections 42,44 that define a U-shaped panel receiving channel 46. Upper ends of side walls 42,44 are outwardly angled to define a panel-receiving entrance 48 to channel 46, for receipt thereinto of an edge portion of panel 70 in a panel mounting direction. Bights 38,40 together define push surfaces for manual urging of the grounding clip onto the panel edge.

Side edges of wall 30 are shown to each include a pointed tooth 50 therealong formed therefrom relatively near top edge 52 thereof and extending toward bottom 54 of channel 46 and toward opposed side walls 42,44. Along side edges 56 of side walls 42,44 are defined enlarged teeth 58 extending toward channel bottom 54 to pointed free ends 60 farther from entrance 48 than the points of teeth 50; preferably, enlarged teeth 58 are curved inwardly toward first side wall 30 and are sufficiently elongated such that the side walls 42,44 act as cantilever beams deflectable outwardly during panel mounting. Slot 62 between second side walls 42,44 increases the resiliency of the side walls 42,44. It can be seen that tab 34 concluding in wire-connecting section 14 is stamped from a blank from that material that is initially between side wall sections 42,44 to define slot 62.

Referring to FIG. 2, grounding clip 200 includes a a panel-engaging section 202 having a first wall 204 and a second wall 206 defining therebetween a panel-receiving channel 208 for receiving a panel in a panel mounting direction. Wire-connecting section 210 extends from top edge 212 of first wall 204, parallel to the panel mounting direction with a wire-receiving channel 214 facing outwardly from the plane of the panel-receiving channel 208, so that upon termination to a wire, the crimped connection will be offset from the panel with the wire extending along the panel parallel to the panel mounting direction. An arm 216 is seen disposed between portions 218 of second side wall 206 in a slot 219, extending integrally from a bottom of first side wall 204. The bottom portions of the bights join side wall sections 218 and arm 216 to first wall 204 and serve as push surfaces. Side wall sections 218 have elongate large teeth 220 for panel engagement similarly to teeth 58 of FIG. 1. A strut 226 extends between and joins side walls 218. In grounding clip 200, the wire-crimping arms 222 are located farther from the channel bottom than insulation-gripping arms 224 so that the wire will exit from the wire-connecting section 210 to extend along the panel surface parallel to the panel mounting direction.

Figure 3:
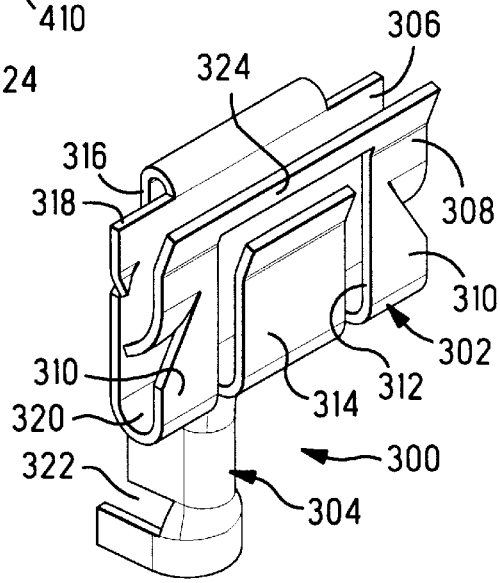
FIG. 3 is an isometric view of a third embodiment of contact wherein the wire-connecting section is defined on a tab extending from a top edge of a side wall, and is offset from the plane of the panel for the wire to extend away from the panel edge.

In FIG. 3, third embodiment of grounding clip 300 is seen to include a panel-engaging section 302 and wire-connecting section 304. Similar to grounding clip 200 of FIG. 2, panel-engaging section 302 has a first side wall 306 and a second side wall 308 having portions 310 defining a slot 312 therebetween with an arm 314 in slot 312. An elongate bent-back tab 316 extends from top edge 318 of first side wall 306 to conclude in wire-connecting section 304 offset below panel-receiving channel 320 and offset therefrom, with wire-receiving channel 322 facing away from the plane of the panel-receiving channel 320. The bottom portions of the bights join side wall portions 310 and arm 314 to first wall 306, serve as push surfaces. A strut 324 adjacent to the channel entrance connects the side wall portions 310.

A fourth embodiment of grounding clip 400 is illustrated in FIG. 4, and includes panel-engaging section 402 and wire-connecting section 404 Panel-receiving channel 410 for receiving a panel in a panel mounting direction is defined between first side wall 408 and second side wall 412, with second side wall 412 comprising a resilient spring arm 413 stamped from first side wall 408 leaving a closed-ended slot 414, bent orthogonally thereto to form a channel bottom 416 and then bent upwardly. Side edge portions 418 of first side wall 408 are bent to extend partially inwardly into panel-receiving channel 410, and include staggered along edges 420 thereof a pair of upper teeth 422 and a pair of lower teeth 424. Elongate teeth 426 are formed along side edges of second side wall 412, spaced from panel-receiving entrance 428. The wire connecting section 404 extends from a lower edge 406 of the first side wall 408 in a direction parallel to the panel mounting direction.

Figure 5:
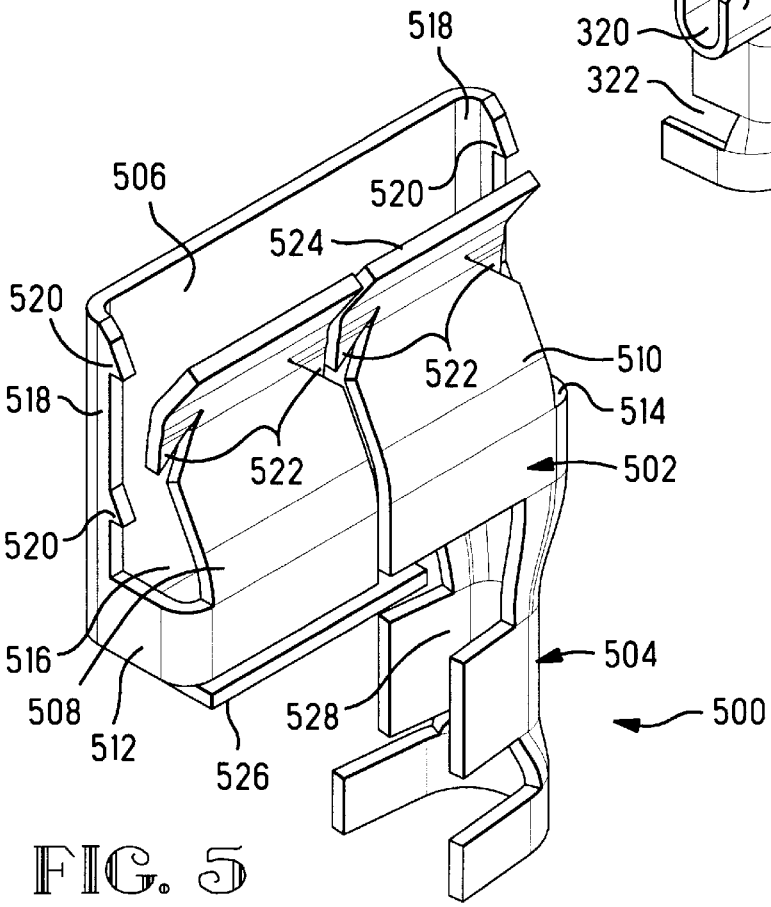
FIG. 5 is an isometric view of a fifth embodiment of the contact wherein the wire-connecting section and the second side wall are formed to extend integrally from side edges of the first side wall.

Referring to FIG. 5, a fifth embodiment of grounding clip 500 includes a panel-engaging section 502 and a wire-connecting section 504. Second side wall sections 508,510 are seen to be joined to first side wall 506 by straps 512,514 to define panel-receiving channel 516, with straps 512,514 oriented on edge with respect to channel 516. As in grounding clip 400, side edge portions 518 of first wall 506 extend into panel-receiving channel 516 and include first and second teeth 520 staggered along side edges thereof. Elongate teeth 522 are defined along both side edges of each second side wall section 508,510 spaced inwardly from panel-receiving entrance 524.

In FIG. 5, a flap 526 is bent orthogonally from the lower edge of first side wall section 506 along the channel bottom. Flap 526 defines a push surface, isolating personnel from sharp edges of the grounding clip during manual urging of the clip onto the panel edge. Wire-connecting section 504 is seen to extend integrally from bottom edges of both second side wall section 510 and also strap 514 joining second side wall section 510 to first side wall 506, with wire-connecting section 504 defining a wire-receiving channel 528 open in a direction parallel to the panel edge.

Other variations and modifications may be made to any of the specific embodiments disclosed herein, that are within the spirit of the invention and the scope of the claims.

What is claimed is:

1. A clip for grounding to a panel at an edge, comprising:

a body section defining a panel-connecting section having a deep U-shaped panel-receiving channel for receiving a panel in a panel mounting direction between walls that include opposed pairs of teeth extending toward a channel bottom, said opposed pairs of teeth being staggered inwardly from an entrance to said channel, said teeth being sharply pointed to establish an assured grounding connection with a panel by scraping away corrosion layers thereon; and a wire-connecting section extending from said panel-connecting section in a direction parallel to the panel mounting direction for minimizing torque on said clip from strain on a wire connected to the clip at said wire-connecting section.

2. The grounding clip as set forth in claim 1 wherein ones of said teeth of each said pair of teeth on a common side of said channel, are disposed on separate wall portions spaced apart from each other to act as cantilever beams deflectable outwardly during panel mounting.

3. The grounding clip as set forth in claim 2 wherein said wire-connecting section extends from an edge of one side wall of said channel at said channel bottom in a direction away from said channel entrance, whereby said wire-connecting section is formed from material separated from between said cantilever beams.

4. The grounding clip as set forth in claim 2 wherein said cantilever beams are joined to a first side wall of said channel-defining walls by straps oriented on edge with respect to said channel and traversing portions of ends of said channel, and said wire-connecting section extends from one said strap.

5. The grounding clip as set forth in claim 4 wherein a flap extends orthogonally from a lower edge of said first side wall along said channel bottom to define a push surface facilitating placement of said clip onto a panel edge.

6. The grounding clip as set forth in claim 2 wherein ends of said cantilever beams are joined by a strut adjacent said channel entrance.

7. The grounding clip as set forth in claim 2 wherein said wire-connecting section extends from an edge of a first side wall of said channel defining walls adjacent said entrance.

8. The grounding clip as set forth in claim 7 wherein said wire-connecting section is bent back along an outer surface of said first wall section.

9. The grounding clip as set forth in claim 7 wherein an arm extends integrally from a bottom of said first side wall and extends upwardly from a bight section across said channel bottom between said cantilever beams to a free end, whereby said bight section defines a push surface facilitating placement of said clip onto a panel edge.

10. The grounding clip as set forth in claim 2 wherein said wire-connecting section extends from lower edges of both said cantilever beams, and a spring arm forming an opposing wall of said channel defining walls is formed from material separated from between said cantilever beams and defining a channel bottom.

11. The grounding clip as set forth in claim 10 wherein side edge portions of said cantilever beams are bent orthogonally thereto to extend partially inwardly into said panel-receiving channel and include staggered along edges thereof a pair of upper teeth and a pair of lower teeth.

* * * * *